US005988259A

United States Patent [19]

Welker et al.

[11] Patent Number: 5,988,259

[45] Date of Patent: Nov. 23, 1999

[54] METHOD AND APPARATUS FOR CONTROLLING THE COOLING OF A STRAND IN A CONTINUOUS CASTING INSTALLATION

[75] Inventors: Hans-Herbert Welker, Herzogoenaurach; Franz Hartleb, Weiterstadt; Otto Gramckow, Erlangen, all of Germany

[73] Assignee: Siemens Aktiengesellschaft, Munich, Germany

[21] Appl. No.: 08/826,218

[22] Filed: Mar. 27, 1997

[30] Foreign Application Priority Data

Mar. 28, 1996 [DE] Germany ..... 196 12 420

[51] Int. Cl.[6] ..... B22D 11/22

[52] U.S. Cl. ..... 164/455; 164/414

[58] Field of Search ..... 164/455, 486, 164/414, 444

[56] References Cited

U.S. PATENT DOCUMENTS

| | | | |
|---|---|---|---|
| 4,463,795 | 8/1984 | Chielens et al. | 164/414 X |
| 4,699,202 | 10/1987 | Gilles | 164/414 X |

FOREIGN PATENT DOCUMENTS

| | | | |
|---|---|---|---|
| 2554026 | 5/1985 | France | 164/455 |
| 2 344 438 | 4/1974 | Germany . | |
| 44 17 808 | 12/1994 | Germany . | |
| 56-151155 | 11/1981 | Japan | 164/414 |
| 57-154364 | 9/1982 | Japan | 164/414 |
| 59-174258 | 10/1984 | Japan | 164/455 |
| 60-54258 | 3/1985 | Japan | 164/455 |
| 63-8868 | 2/1988 | Japan | 164/455 |

OTHER PUBLICATIONS

Hans G. Baumann, Steel Continuous Casting, Verlag Stahieisen mbH, Dusseldorf, 1976, pp. 23–42.

*Primary Examiner*—J. Reed Batten, Jr.
*Attorney, Agent, or Firm*—Hill & Simpson

[57] ABSTRACT

Method and apparatus for controlling the cooling of a strand in a continuous casting installation, in which the cooling or, respectively, the solidification behavior of the strand ensures by means of the quantity of cooling agent used for cooling the strand, whereby the required quantity of cooling agent is determined, constantly and in real time, dependent on a predetermined target temperature distribution. A cooling model is used with which a temperature distribution in the strand can be calculated from a quantity of cooling agent.

13 Claims, 2 Drawing Sheets

METHOD AND APPARATUS FOR CONTROLLING THE COOLING OF A STRAND IN A CONTINUOUS CASTING INSTALLATION

BACKGROUND OF THE INVENTION

The invention relates to means and methods for controlling the cooling of the resultant strand in a continuous casting installation.

It is known to partition into segments the cooling means for the cooling of a strand during continuous casting. What is known as a cooling curve, i.e. a target cooling of the strand depending on strand speed, i.e., casting speed, is thereby allocated to each strand segment. By measuring the strand speed, the optimal target cooling of the strand in the region of a cooling segment is determined via the cooling curve, and the quantity of cooling agent (e.g. the amount of water, given water spray means for cooling) is set corresponding to this target cooling. In this way it is possible to cool a strand acceptably given a constant strand speed or, respectively, given a strand speed that is changes relatively slowly. However, these ideal conditions are not always present. Rather, during operation, more rapid changes in the strand speed can occur such that the cooling is no longer acceptable using the known method. This applies in particular under the condition that the strand speed is strongly dependent on operational demands, such as for example the supply of the casting material.

German patent DE 44 17 808 A1, fully incorporated herein by reference, discloses a method for continuous casting of a metal strand, whereby a strand with a liquid core enclosed by a strand shell is drawn out of a cooled open-ended mold, and is supported in a strand support means downstream from the open-ended mold and is cooled using a cooling agent. In order to take into account changes in the thermodynamic state of the strand, such as changes in the surface temperature of the center temperature of the shell thickness, and also the mechanical state, such as the deformation behavior, etc., these are constantly included in a mathematical simulation model through solution of a heat conduction equation. Thus, the cooling model disclosed in DE 44 17 808 A1 is an inverse cooling model, i.e., a cooling model that calculates the cause (quantity of cooling agent) dependent on the effect (temperature). In a procedure of this sort, the heat equations are solved. However, there is a limit in the degree, i.e, the depth of a possible modeling of the actual heat relationships in the strand. This limitation of the depth of the model significantly restricts the precision in the calculation of the strand temperature.

SUMMARY OF THE INVENTION

The invention provides a method, and a means for carrying out the method, for improved strand cooling, even given varying strand speed.

In an embodiment, the invention provides a means or, respectively, a method for controlling the cooling of a strand in a continuous casting apparatus, in which the cooling or, respectively, the solidification behavior of the strand can be influenced by the quantity of cooling agent (e.g. water) used for the cooling of the strand, as well as the manner in which the cooling agent is applied, whereby the necessary quantity of cooling agent or, respectively, manner of application is determined, constantly and in real time, depending on a predetermined target temperature curve or distribution for the strand or, respectively, on an equivalent quantity. By real time, punctuality is to be understood, as well as a determination of the required quantity of cooling agent in a shorter time than the time constants of a continuous casting installation. The determination of the required quantity of cooling agent or, respectively, manner of application thereof, thereby ensues by means of a cooling model that establishes a relation between the quantity of cooling agent or, respectively, manner of application thereof and a calculated temperature curve for the strand.

What is to be understood by the term or phrase "manner of application" herein, refers to and means a set of parameters that can be used to control the application of the cooling agent, apart from mere quantity of cooling agent. Such parameters can include timing, form, etc., as would be readily understood by those of ordinary skill in the art.

In accordance with the invention, strand temperature is calculated using a cooling model whereby the modeling depth of the cooling model is increased in relation to the known method. For this purpose, two measures are proposed.

Firstly, using the cooling model, the temperature distribution in the strand, is constantly calculated in real time depending either on the quantity of cooling agent and/or manner of application of the cooling agent, and that the required quantity of cooing agent, or manner of application thereof is determined iteratively, depending on a predetermined target temperature distribution ($S_0$), whereby the iteration is repeated until the deviation of a temperature distribution ($S_i$) calculated using the cooling model from a predetermined target temperature distribution ($S_0$) is smaller than a predetermined tolerance value.

Secondly, the cooling model preferably is a neural network, in particular a self-configuring one, by means of which the necessary quantity agent or manner of application thereof is constantly determined in real time.

A construction of the foregoing type is of particular advantage, since the cooling model with temperature dependence on the cooling quantity reflects the cause-effect relationship between cooling and temperature in the strand.

In an advantageous construction of the invention, the stipulation of a target temperature curve for the strand ensues in the form of temperatures at selected points of the strand, advantageously on the surface of the strand.

In a further advantageous construction of the invention, for the determination of the required quantity of cooling agent or, respectively, the manner of application thereof, depending on the predetermined target temperature curve for the strand, the strand dimensions, strand shell thickness, time, strand material, heat of crystallization, cooling agent pressure, size of the drops of the cooling agent and cooling temperature are used. The use of these quantities is particularly suited for achieving a particularly precise value for the required quantity of cooling agent or, respectively, manner of application thereof.

These and other features of the invention are discussed in greater detail below in the following detailed description of the presently preferred embodiments with reference to the accompanying drawings.

DETAILED DESCRIPTION OF THE PRESENTLY PREFERRED EMBODIMENTS

Figure 1:
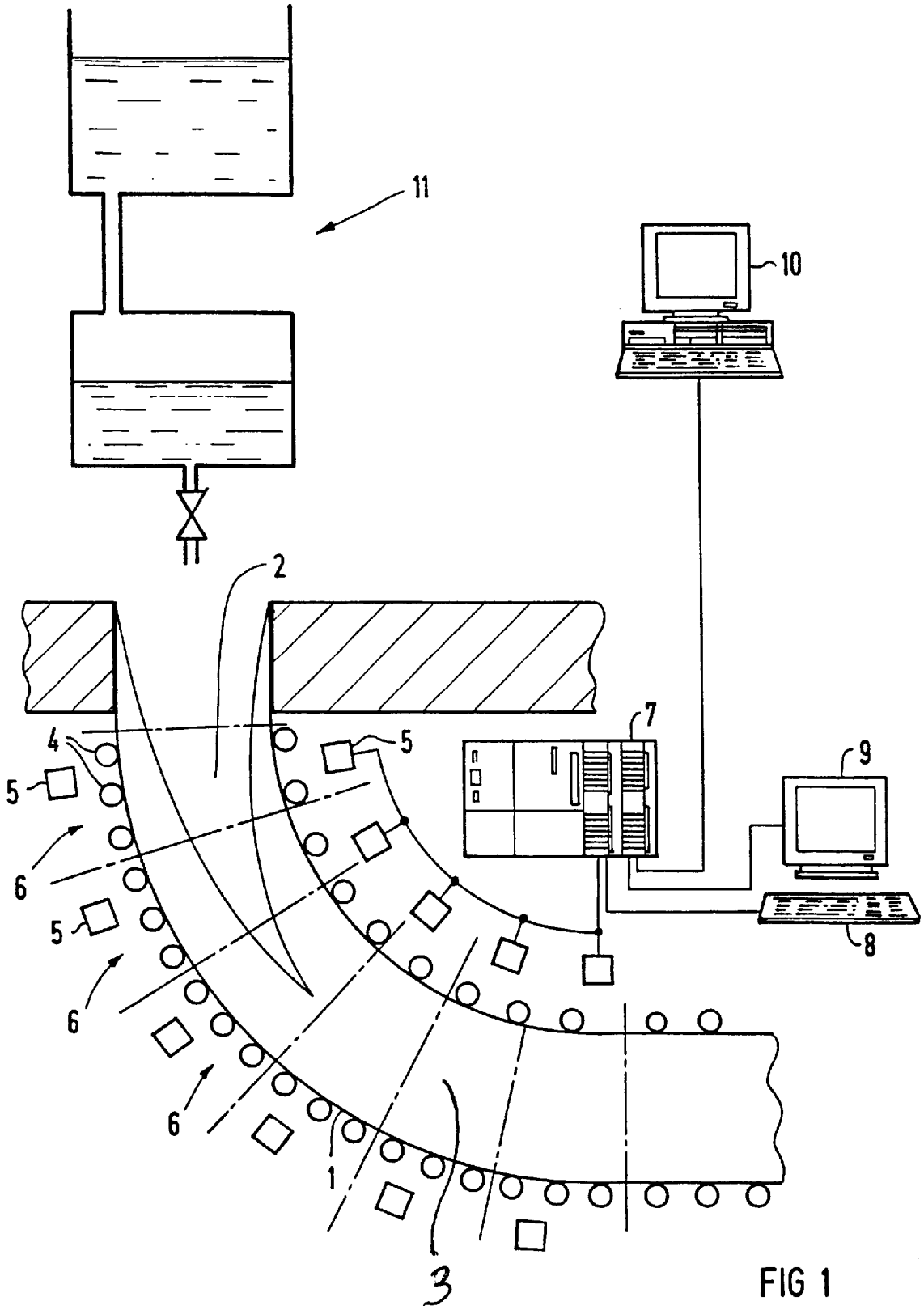
FIG. 1 illustrates a continuous casting installation.

FIG. 1 illustrates a continuous casting installation. Reference number 1 designates a cast strand, comprising a solidified part 3 and a liquid basin part 2. The strand 1 is moved by means of drive rollers or, respectively, guide rollers 4, and is cooled along its path by cooling means 5. The cooling means advantageously are constructed as water-spraying means. For reasons of clarity, not all the drive rollers or, respectively, guide rollers 4 and cooling means 5 are provided with reference numbers.

In the known method, the cooling means 5 are partitioned into cooling segments 6. This partitioning is not required in accordance with the new and inventive method, but can be taken into account. Both the drive rollers 4 and the cooling means are connected to a computing installation for data processing. In the present exemplary embodiment, both are connected to one and the same memory-programmable control unit 7 for data processing.

The memory-programmable control unit 7 optionally comprises a terminal 9 and a keyboard 8. In addition, the memory-programmable control unit 7 is connected to a higher-level computing system 10.

The material for continuous casting, in the illustrated case, liquid steel, is supplied via a supply means 11. The setting quantities for the cooling means 5 are calculated by means of a cooling model, i.e. a thermal model of the strand, which in the exemplary embodiment is implemented on the higher-level computing system 10.

Figure 2:
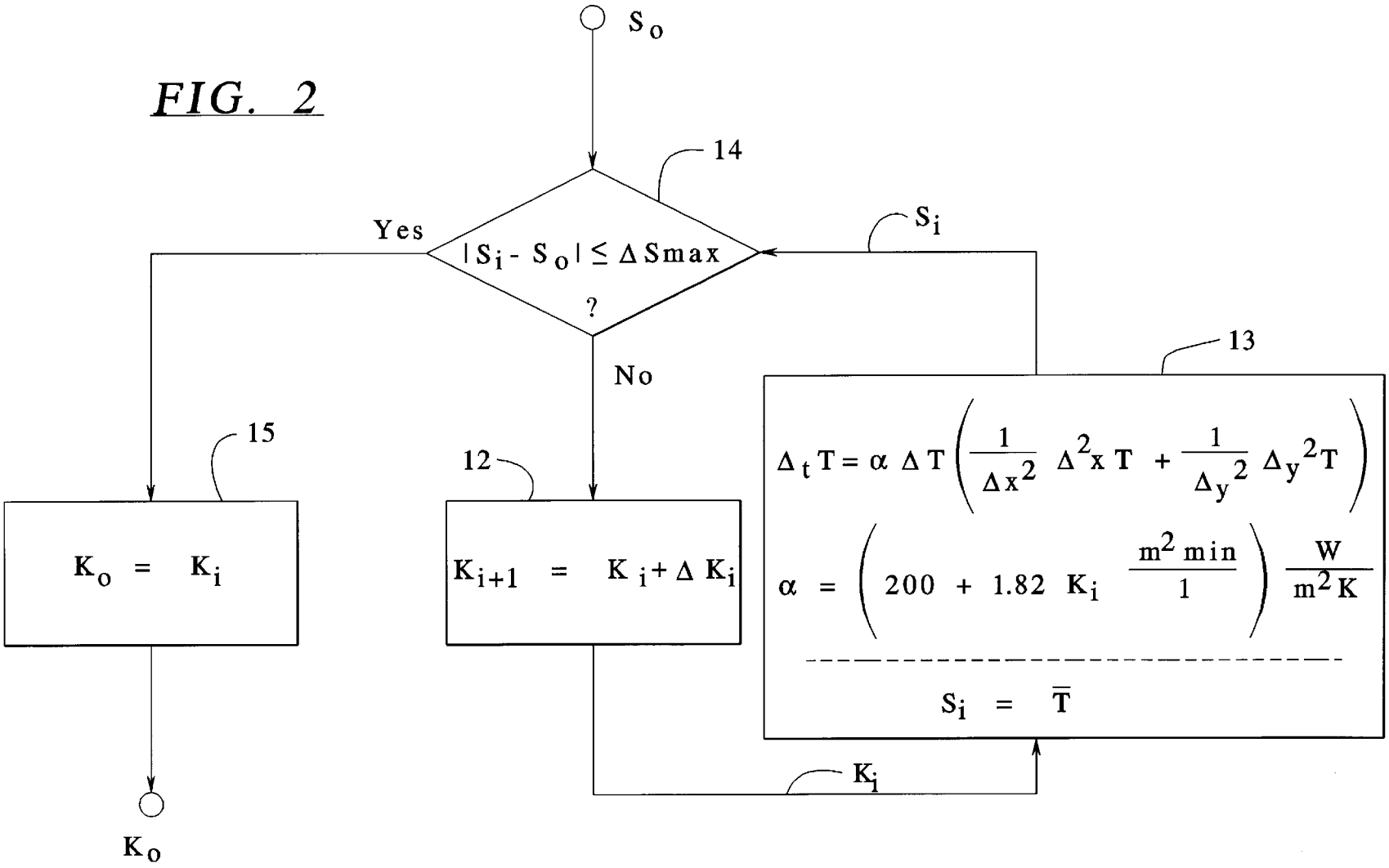
FIG. 2 illustrates a flow diagram for the iterative determination of a target cooling agent quantity or, respectively, manner of application thereof, by means of a cooling model.

FIG. 2 illustrates a flow diagram for the iterative determination of a target quantity of cooling agent or, respectively, manner of application $k_0$ thereof by means of a cooling model 13. For this purpose, the temperature curve $s_i$ for the strand is determined from a given calculated or required quantity of cooling agent or, respectively, manner of application $k_i$ thereof by means of the cooling model 13. In a comparator 14, this temperature curve $s_i$ is compared with the target temperature curve $s_0$ for the strand. In the comparator 14, the query whether $|s_i-s_0|\leqq\Delta s_{max}$ ensues, $\Delta s_{max}$ being a predetermined tolerance value. If the absolute value of the difference between $s_i$ and $s_0$ is too large, the function block 12 determines a new calculated or required quantity of cooling agent or, respectively, manner of application thereof $k_i$. A new value is thus calculated for $k_i$, according to:

$$k_{i+1}=k_i+\Delta k_i(i.e.,\ k_{new}=k_{old}+\Delta k_i),$$

whereby $\Delta k_i$ is a change in the quantity of cooling agent in the sense of an optimization. If, for example, $s_i>s_0$ and $|s_i-s_0|\leqq\Delta s_{max}$, then $\Delta k_i$ has a negative sign, i.e., the quantity of cooling agent is reduced.

As an initial value for the iteration, a value is used for the quantity of cooling agent or, respectively, manner of application thereof that has proven on average to be a successful value, based on experience over a long period of time. If the absolute value of the difference between $s_i$ and $s_0$ is smaller than or equal to the tolerance value $\Delta s_{max}$, then the target quantity of cooling agent or, respectively, manner of application $k_0$ thereof is set equal to the calculated or required quantity of cooling agent or, respectively, manner of application $k_i$ thereof, with a target cooling determination function 15. That is, function block 15 contains the equation $k_0=k_i$. The target quantity of cooling agent or, respectively, manner of application $k_0$ thereof thereby represents the setting quantity or, respectively, guide quantity for the cooling means of the continuous casting installation or, respectively, the regulation thereof.

The values $s_i$, $s_0$, $\Delta s_{max}$, $k_i$, $k_0$ are not necessarily scalars, but rather columnar matrices of one or more values. Thus, the columnar matrix $k_0$ can contain, for example, the different setting or guide quantities for the cooling means of the individual cooling segments of a continuous casting installation. The columnar matrix $s_0$ can contain the target temperatures at various points of the strand.

The cooling model 13 can be implemented both as a one-dimensional model for slabs and as a two-dimensional model for strands. The basis of the cooling model is represented by the heat transfer equation (shown here for the two-dimensional case):

$$\frac{\delta T}{\delta t}=\alpha\left(\frac{\delta^2 T}{\delta x^2}+\frac{\delta^2 T}{\delta y^2}\right)$$

which for the cooling model 13 is used in difference or, differential form, i.e. in the form:

$$\Delta_t T=\alpha\Delta T\left(\frac{1}{\Delta x^2}\Delta_x^2 T+\frac{1}{\Delta y^2}\Delta_y^2 T\right)$$

T is thereby the temperature, t is time, and $\alpha$ is the heat conductivity, the designations x and y are the two-dimensional spatial coordinates.

In the 1976 article entitled "Steel Continuous Casting Apparatuses" by Dr. -Ing. Hans G. Baumann, there is disclosed such a temperature model. This article is fully incorporated herein by reference.

In utilizing the model, the cross-section of the skin of the strand is partitioned into small rectangles of size $\Delta x$ times $\Delta y$, and the temperature is calculated in small time steps $\Delta t$. As a starting point for the temperature distribution, it is assumed that the temperature upon entry into the mold (in all the rectangles) has the melting temperature $T_s$ of steel (or the metal in question).

The heat Q to be transferred from the strand surface is calculated from the surface temperature $T_O$ of the strand, the ambient temperature $T_U$, the surface A and the heat transfer coefficient $\alpha$, with $Q=\alpha(T_U-T_O)A$.

For the cooling in the mold, $\alpha$ is assumed to be constant, and $T_U$ is set equal to the temperature of the cooling water in the mold. For cooling in the cooling zones, $T_U$ is set equal to the temperature of the spray water, and $\alpha$ is calculated according to the relationship:

$$\alpha=\left(200+1.82k_i\ \frac{\mathrm{m^2min}}{\mathrm{l}}\right)\frac{\mathrm{W}}{\mathrm{m^2K}}$$

whereby $\alpha$ is the volume of the cooling water in $$\frac{\mathrm{l}}{\mathrm{m^2min}}$$

(liters per meters squared minutes). The number $k_i$ can thereby be indicated differently for each point on the strand surface, whereby nozzle characteristic features can also be specified with the model. In this relationship, "l" is liters, "m" is meters, "W" is watts and "K" is degrees Kelvin.

Besides the curve of the temperature distribution in the strand, the model also calculates the curve of the front of the solidification, and thus also the point in time (or, respectively, the distance from the mold) of the complete solidification of the strand.

The individual model parameters include, among others:

Mold length

Strand geometry (height and width)

Strand speed

Heat transfer coefficient a in the mold

Temperature of cooling water in the mold

Melting temperature

Enthalpy of solidification

Heat transfer coefficient $\lambda$

Specific heat capacity c

Density $\rho$

Length of each cooling zone

Volume $k_i$ of cooling water in each cooling zone

The temperature dependencies of $\lambda$, c and $\rho$ are taken into account in the model. The temperature curve $S_i$ results as a set of the average values $\overline{T}$ of the temperature values T in a particular strand segment, in particular in a cooling segment. Again, refer to the Baumann article.

By using a procedure wherein the temperature distribution in a strand is constantly calculated based on the amount of cooling agent used or manner of application thereof, as described above, it is possible to use a cooling model that is not inverse, i.e., that calculates the effect of the dependence of the cause. In this way, the modeling depth if not unnecessarily restricted. In contrast, the heat equation according to DE 44 17 808 A1 must be simply constructed so that the cause can be represented as a function of the effect. Thus, only simple models are possible. In order to obtain a complex modeling using these simple models, a model must be constructed from many small submodels. However, this is very costly and highly inflexible. A particular disadvantage of DE 44 17 808 A1 is the use of many small submodels as a separate cooling model must be produced for each continuous casting installation, since the number and type of the submodels vary. This process can be very costly and expensive. In contrast, the inventive procedure allows the use of existing complex cooling models, which can be adapted to different continuous casting installations through simple alterations of their parameters. In this way, a modeling is achieved with particularly high precision and low expense.

The use of a neural network likewise allows a very complex modeling that can considerably increase the precision of the calculation of the strand temperature. A particular advantage of the neural network is thereby that the modeling based on neural network avoids the formation of a complex inverse cooling model that determines the cause dependent on the effect.

It can be appreciated that the inventive method provides for a more precise determination of the strand temperature, which in turn allows a more precise cooling of the strand. This improved cooling leads in turn to an increase in the steel quality, and thereby to an economic advantage.

Although modifications and changes may be suggested by those skilled in the art, it is the intention of the inventors to embody within the patent warranted hereon all changes and modifications as reasonably and properly come within the scope of their contribution to the art.

We claim:

1. A method for controlling the cooling of a strand in a continuous casting installation, in which the cooling behavior of the strand can be influenced by quantity of cooling agent used to cool the strand, as well as by the manner in which the cooling agent is applied, whereby a required quantity of cooling agent or manner of application thereof is determined using a cooling model and depends upon a predetermined target temperature distribution in the strand comprising the steps of:

using the cooling model, determining a temperature distribution in the strand ($s_i$) in real time, dependent on the required quantity of cooling agent or, respectively, the manner of application thereof, and iteratively determining the required quantity of cooling agent or, respectively, the manner of application thereof dependent on a predetermined target temperature distribution ($s_0$), whereby the iteration is repeated until a deviation of the temperature distribution ($s_i$) determined using the cooling model from the predetermined target temperature distribution ($s_0$) is within a predetermined tolerance value.

2. The method of claim 1, wherein the cooling model comprises differential equations.

3. The method of claim 1, wherein the cooling model is an inverse cooling model and the determination of the required quantity of cooling agent or, respectively, the manner of application thereof is undertaken using the predetermined target temperature distribution in the strand.

4. The method of claim 1, wherein using the cooling model, the temperature distribution in the strand is determined dependent on the quantity of cooling agent or, respectively, the manner of application thereof, and the required quantity of cooling agent or, respectively, the manner of application thereof is determined iteratively, dependent on a predetermined target temperature distribution ($s_0$), whereby iteration is repeated until the deviation of the temperature distribution ($s_i$) determined using the cooling model from the predetermined target temperature distribution ($s_0$) is smaller than a predetermined tolerance value.

5. The method of claim 1, wherein the cooling model is a combination of an analytical model and a neural network.

6. The method of claim 1, wherein the model is self-configured to the process by means of on-line learning by the neural network.

7. A method for controlling the cooling of a strand in a continuous casting operation, comprising the steps effected in a process controller of:

(A) providing a target temperature distribution for the strand;

(B) providing an initial required quantity of cooling agent or manner of applying the cooling agent to achieve the target temperature distribution;

(C) calculating a temperature distribution for the strand that would result given application of the required quantity of cooling agent or manner of applying the cooling agent;

(D) comparing the calculated temperature distribution with a target temperature distribution for the strand;

(E) until an absolute difference between the target and calculated temperature distributions for the strand is less than or equal to a predetermined tolerance value, (1) determining a new required quantity of cooling agent or new manner of applying the cooling agent and (2) recalculating the calculated temperature for the strand;

(F) if the absolute difference between the target and calculated temperature distributions is less than or equal to the predetermined tolerance value, setting a target quantity of cooling agent or manner of applying the cooling agent equal to the required quantity of cooling agent or manner of applying the cooling agent, respectively; and (G) effecting application of the cooling agent.

8. The method of claim 7, wherein the step of determining a required quantity of cooling agent or manner of applying the cooling agent comprises increasing the amount of required cooling agent to be applied by a predetermined amount if the calculated temperature distribution exceeds the target temperature distribution, but otherwise decreasing the required cooling agent to be applied by the predetermined amount if the calculated temperature distribution is less than the target temperature distribution.

9. The method of claim 7, wherein the step of calculating the temperature distribution for the strand comprises employing a differential heat transfer relationship whereby the temperature for a given portion of the strand is determined in part by the amount of heat which would be removed from the strand by the required quantity of cooling agent or manner of applying the cooling agent.

10. The method of claim 9, wherein the step of calculating the temperature distribution comprises employing the following relationship:

$$\frac{\delta T}{\delta t} = \alpha\left(\frac{\delta^2 T}{\delta x^2} + \frac{\delta^2 T}{\delta y^2}\right),$$

wherein T is temperature, t is time, and $\alpha$ is the heat conductivity, and the designations x and y are the two-dimensional spatial coordinates.

11. A strand cooling apparatus, comprising a process controller programmed to effect the following steps:

(A) providing a target temperature distribution for the strand;

(B) providing an initial required quantity of cooling agent or manner of applying the cooling agent to achieve the target temperature distribution;

(C) calculating a temperature distribution for the strand that would result given application of the required quantity of cooling agent or manner of applying the cooling agent;

(D) comparing the calculated temperature distribution with a target temperature distribution for the strand;

(E) until an absolute difference between the target and calculated temperature distributions for the strand is less than or equal to a predetermined tolerance value, (1) determining a new required quantity of cooling agent or new manner of applying the cooling agent and (2) recalculating the calculated temperature for the strand;

(F) if the absolute difference between the target and calculated temperature distributions is less than or equal to the predetermined tolerance value, setting a target quantity of cooling agent or manner of applying the cooling agent equal to the required quantity of cooling agent or manner of applying the cooling agent, respectively; and (G) effecting application of the cooling agent.

12. The apparatus of claim 10, wherein: the step of determining a required quantity of cooling agent or manner of applying the cooling agent comprises increasing the amount of required cooling agent to be applied by a predetermined amount if the calculated temperature distribution exceeds the target temperature distribution, but otherwise decreasing the required cooling agent to be applied by the predetermined amount if the calculated temperature distribution is less than the target temperature distribution.

13. The apparatus of claim 11, wherein: the step of calculating the temperature distribution for the strand comprises employing a differential heat transfer relationship whereby the temperature for a given portion of the strand is determined in part by the amount of heat which would be removed from the strand by the required quantity of cooling agent or manner of applying the cooling agent.

* * * * *